US006425462B1

(12) United States Patent
Tran et al.

(10) Patent No.: US 6,425,462 B1
(45) Date of Patent: Jul. 30, 2002

(54) GRAVITY-ASSISTED ELEVATOR BRAKE/ CLUTCH

(76) Inventors: Su The Tran, 1310 SuSan Ave., Croydon, PA (US) 19021; Musoke Henry Sendaula, 10726 Wynstone Pl., Helotes, TX (US) 78023

( * ) Notice: Subject to any disclaimer, the term of this patent is extended or adjusted under 35 U.S.C. 154(b) by 0 days.

(21) Appl. No.: 09/814,670

(22) Filed: Mar. 23, 2001

Related U.S. Application Data

(60) Provisional application No. 60/245,529, filed on Nov. 3, 2000.

(51) Int. Cl.[7] ..... B66B 5/12

(52) U.S. Cl. ..... 187/367; 187/376

(58) Field of Search ..... 187/376, 372, 187/366, 367, 370; 188/67, 38

(56) References Cited

U.S. PATENT DOCUMENTS 1,167,702 A * 1/1916 Leal ..... 187/366
1,867,991 A * 7/1932 Shinn ..... 187/368
5,014,828 A 5/1991 Baldassarre
5,234,079 A 8/1993 Nomura
5,253,738 A 10/1993 Vertesy
5,363,942 A * 11/1994 Osada ..... 187/376
5,518,087 A 5/1996 Hwang
6,235,184 B1 * 12/2001 Lujan ..... 188/366

* cited by examiner

*Primary Examiner*—Matthew C. Graham

(57) ABSTRACT

An elevator brake that utilizes the elevator platform weight to generate the necessary clamping force for stopping the elevator is disclosed. Electromagnetically released safety systems that have been considered for ropeless linear motor elevator systems rely on resilient or spring members to generate the clamping force. As the weight of the platform increases, the clamping forces and the size of the springs have to be appropriately increased. In the gravity-assisted elevator brake, the clamping force is generated by the total cargo and elevator platform weight, while small springs are used to activate the brake. It is unlikely that a ropeless elevator platform will tethered to a large power cable, so supplying large amounts of power to the safety systems could be a problem. The force needed to release and set the gravity-assisted elevator brake under normal operations would be minimal so the brake can be operated from a low power source.

6 Claims, 4 Drawing Sheets

GRAVITY-ASSISTED ELEVATOR BRAKE/ CLUTCH

This application claims benefit of Ser. No. 60/245,529 filed Nov. 3, 2000.

BACKGROUND OF THE INVENTION

1. Technical Field

An elevator brake that utilizes the elevator platform weight to generate the clamping force for stopping the elevator is disclosed. The gravity-assisted elevator brake can constitute a safety system for ropeless or non-trunked elevators in which the conventional overspeed governor-based safety systems can not be used. The gravity-assisted elevator brake unit that can be released and applied with minimal force so it does not require a large power supply.

2. Prior Art

In a ropeless or non-trunked elevator platform system, there are no ropes; the lift force is often from a linear motor. Conventional overspeed governor-based safety systems can not be used in this case. U.S. Pat. No. 5,234,079 disclosed a ropeless linear motor elevator system comprising a brake unit and an electromagnetic brake. The brake systems include brake shoes and mechanisms to engage the brake shoes with the rails to stop the platform. The brake unit as a parking brake is mounted between the drive unit and the platform and it consists of a pair of brake shoes mounted on the elevator platform with a mechanical actuator to apply and release the brake. The electromagnetic brake is mounted below the platform and it also consists of a pair of brake shoes mounted on the elevator platform with an electromechanical actuator to apply and release the brake. In the brake unit and the electromechanical brake, the forces that clamp the brake shoes against the rails are generated by the set of springs. As the weight of the platform increases, the clamping forces and the size of the springs have to be appropriately increased. Increasing the-spring forces will require increasing power of the actuators that apply to release the brake during operation.

A safety disc brake system for lifts that is released electromagnetically was described in U.S. Pat. No. 5,253,738. U.S. Pat. No. 5,518,087 presented a rail brake apparatus for a linear motor elevator. This invention is an improvement over the disc safety brake system in U.S. Pat. No. 5,253,738 and the electromagnetic brake with clamping jaws that was described in U.S. Pat. No. 5,014,828. Even with these improvements, a large force is still needed to operate the brake. In these patents the clamping forces and hence the power requirements for the electromagnets are not disclosed. It is unlikely that a ropeless elevator platform will tethered to a power cable, so supplying large amounts of power to the safety systems could be a problem.

Electromagnetically released safety systems that have been considered for ropeless linear motor elevator systems rely on resilient or spring members to generate the clamping force. As the weight of the platform increases, the clamping forces and the size of the springs have to be appropriately increased. The force needed to counteract the spring-preset force must be greater than clamping force.

OBJECTIVES AND ADVANTAGES

The object of this invention to provide a ropeless elevator a safety system that utilizes the weight of the elevator platform to generate large and necessary clamping force thus minimizing the power required operating the brake.

Another object of this invention is to develop a brake system that can be a parking brake and an emergency brake when the lift system fails or when power is lost while necessary power to keep the braking pads ajar from the rail is minimal and independent from the weight of the platform and cargo.

Another important object of this invention is to develop a brake system in which clamping force is self adjusted according to the total weight of cargo and elevator.

SUMMARY OF THE INVENTION

This invention is to provide a safety system for high capacity ropeless elevator platform. In developing brakes for high capacity platforms, generating the large clamping forces with limited power sources on the platform is a major problem. To illustrate the problem, consider the motion of the platform during braking. The variables are as follows:

M mass of platform and cargo.

B Drag on the platform, assumed to be zero $F_B$ Braking Force $V_{int}$ Initial platform speed before the brake is applied (assumed going down)

W Weight of the platform and cargo $t_s$ Stopping time $_{after}$ the brake is applied It follows from linear motion analysis that the brake force $F_B$ needed to stop the platform in $t_s$, is given by:

$$F_B=W+M\ V_{int}/t_s. \tag{1}$$

The term ($M\ V_{int}/t_s$) represents the change in momentum. The braking force $F_B$ is due to a clamping force $F_G$. The clamping force $F_G$ is often due to a braking unit reacting against a rail. The braking force is given by $$F_B=\mu F_G \tag{2}$$

$\mu$ is the coefficient of friction, in this case this will be the coefficient of friction between the clamping rollers or pads and the rails.

Hence the clamping force $F_G$, is given by:

$$F_G=(W+M\ V_{int}/t_s.)/\mu. \tag{3}$$

So the clamping force without gravity assist has to exceed the total weight of the platform and cargo by a factor of $1/\mu$, even if the momentum term is neglected.

Consider a ropeless platform on a ship. For completeness, assume that the platform weighs 6000 lbf with a load of 12,000 lbf. In relatively high sea states, the effective weight of the platform, is approximately 27,000 lbf. Assuming a $\mu$=0.5, the clamping force has to exceed 54,000 lbf. Given the initial speed of the platform and the reaction time of the braking system, a more accurate estimate of the clamping force can be calculated using equation (3). To develop clamping forces using springs, the actuator for releasing the brake even with a mechanical advantage of 10, will still have to apply well over 5000 lbf. In the gravity-assisted elevator brake the clamping force is developed from the elevator platform and load weight. The weight is magnified by the mechanical advantage of the lever arm.

BRIEF DESCRIPTION OF THE DRAWINGS AND REFERENCE NUMERALS

The following illustrations would clarify the brief description and the detailed description:

LIST OF NUMERALS

Figure 1:
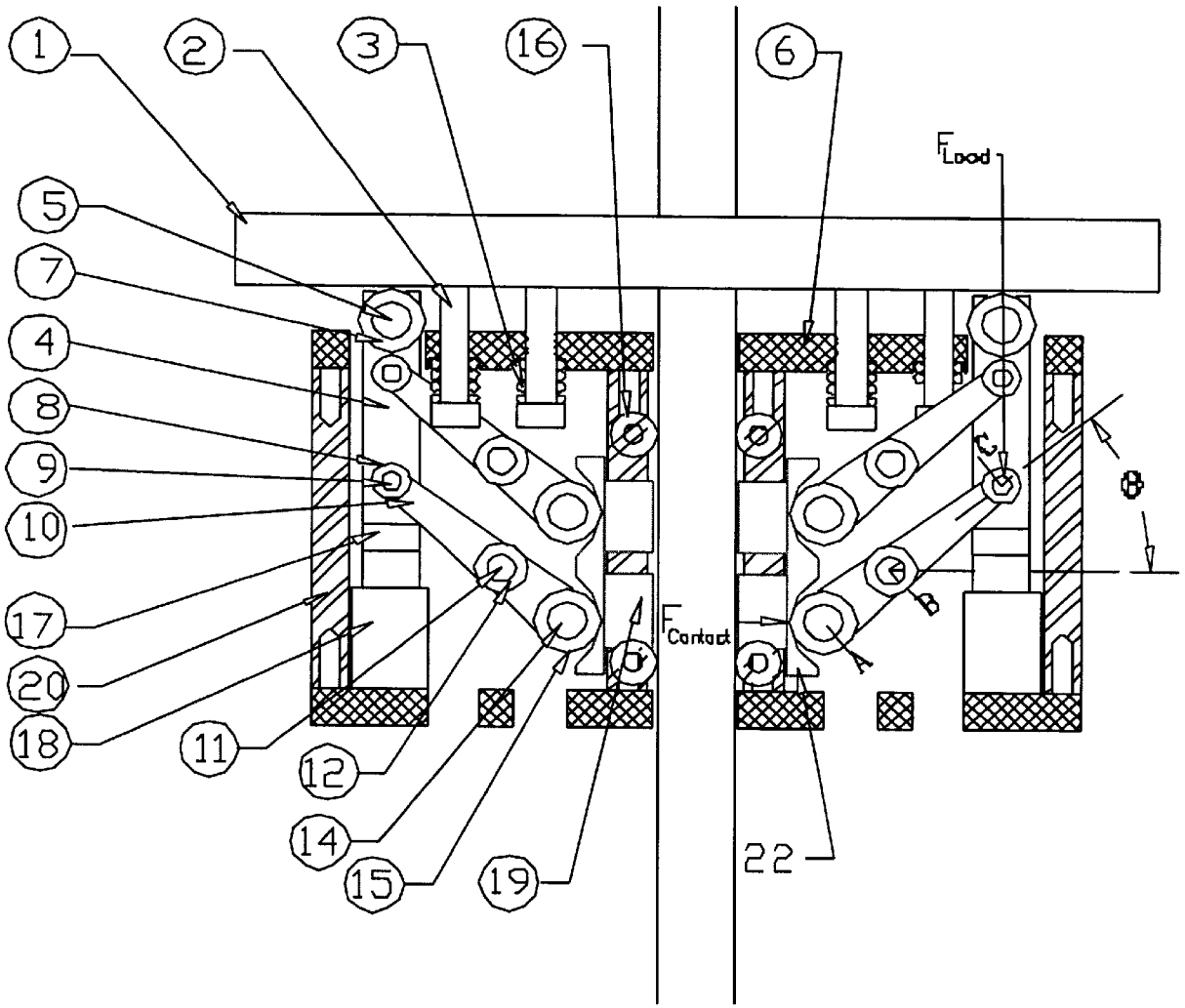
FIG. 1 is a cut away front view of the preferred embodiment of the gravity-assisted elevator brake unit.

1 Adapter plate
2 Spring studs
3 Activator spring
4 Load plate
5 Load pin
6 Brake housing
7 Load bearing
8 Armload bearing
9 Activator pin.
10 Activator arm.
11 Fulcrum pin
12 Fulcrum bearing pair.
14 Contact pin
15 Contact bearing pair
16 Guide bearing
17 Release plate
18 Brake release element
19 Braking plate
20 Casing
21 Guide bearing pins
22 Braking plate spring
23 Adapter plate screw
24 Rail
25 Assembled brake unit Less adapter plate

DETAILED DESCRIPTION OF THE PREFERRED EMBODIMENT

FIG. 1 shows a cut away view of a gravity-assisted elevator brake unit 25 that is attached to the adapter plate 1 by set spring studs 2. The spring studs 2 form a part of the top cover of the brake housing 6 on top of activator springs 3. Load plates 4 transmit the elevator platform weight to the rest of the braking mechanism. Load bearings 7 are always in contact with adapter plate 1. Activator springs 3 are wedged compressively between spring studs 2 and the top of the housing 6. Load bearings 7 are mounted on load pins 5 that in turn are mounted in the holes on top of the load plates 4. The load plates 4 are connected on top by pins 5 and at the bottom by plates 17. Pairs of armload bearings 8 are embedded in load plates 4 and are connected to activator arms 10 through pins 9. The fulcrum pins 11 connect activator arms 10 and the fulcrum bearing pairs 12. The fulcrum bearing pairs 12 are embedded in brake unit housing 6 on one side and in cavities in the casings 20. The contact pins 14 connect activator arms 10 to contact bearing pairs 15. Contact bearing pairs 15 are always in contact with braking plates 19. Casings 20 house the braking plates 19. The braking plates 19 are separated from the casing 20 by springs 22 inside the braking plates. Casings 20 also have housing to hold guide bearings 16. At bottom of the load plates 4 are connector plates 17 that is in contact with the brake release element 18. Brake release element 18 could be a push solenoid sized to provide a force at most one and half the weight of the brake unit. As load plates 4 transmit the platform weight to activator arms 10 through the pairs of load bearings 8, the activator arms 10 rotate about pins 11 thus pushing bearing elements 15 into braking plates 19, that in turn clamp against the rail 24.

Figure 2:
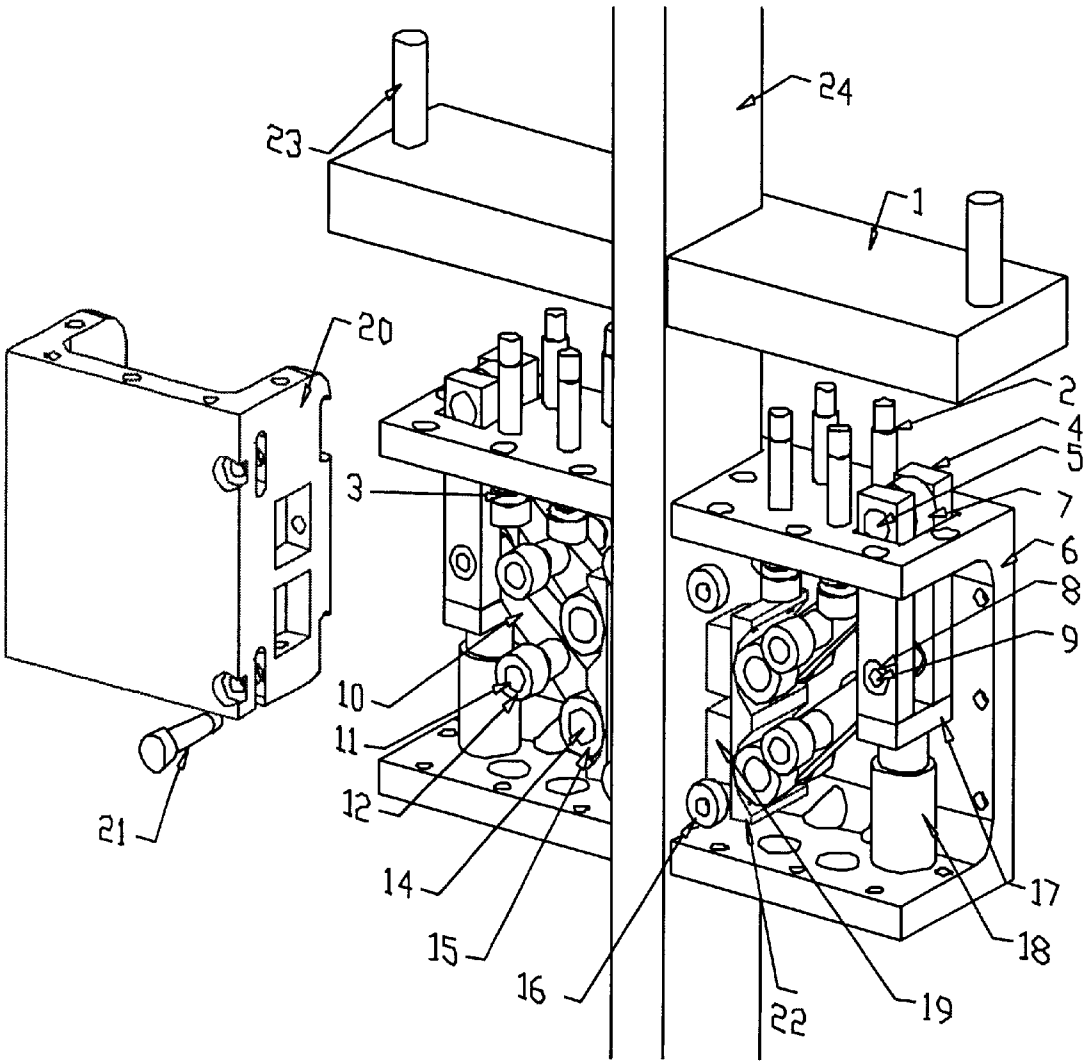
FIG. 2 is the exploded view of the preferred embodiment of a gravity-assisted elevator brake.

FIG. 2 shows an exploded view of a preferred embodiment of a gravity-assisted elevator brake. The left casing 20 is shown separated from brake housing 6, the right casing 20 is not shown. Casing 20 has cavities to accommodate fulcrum bearings 12, it also it has openings for the braking plates 19, and housing for guide bearings 16.

Figure 3:
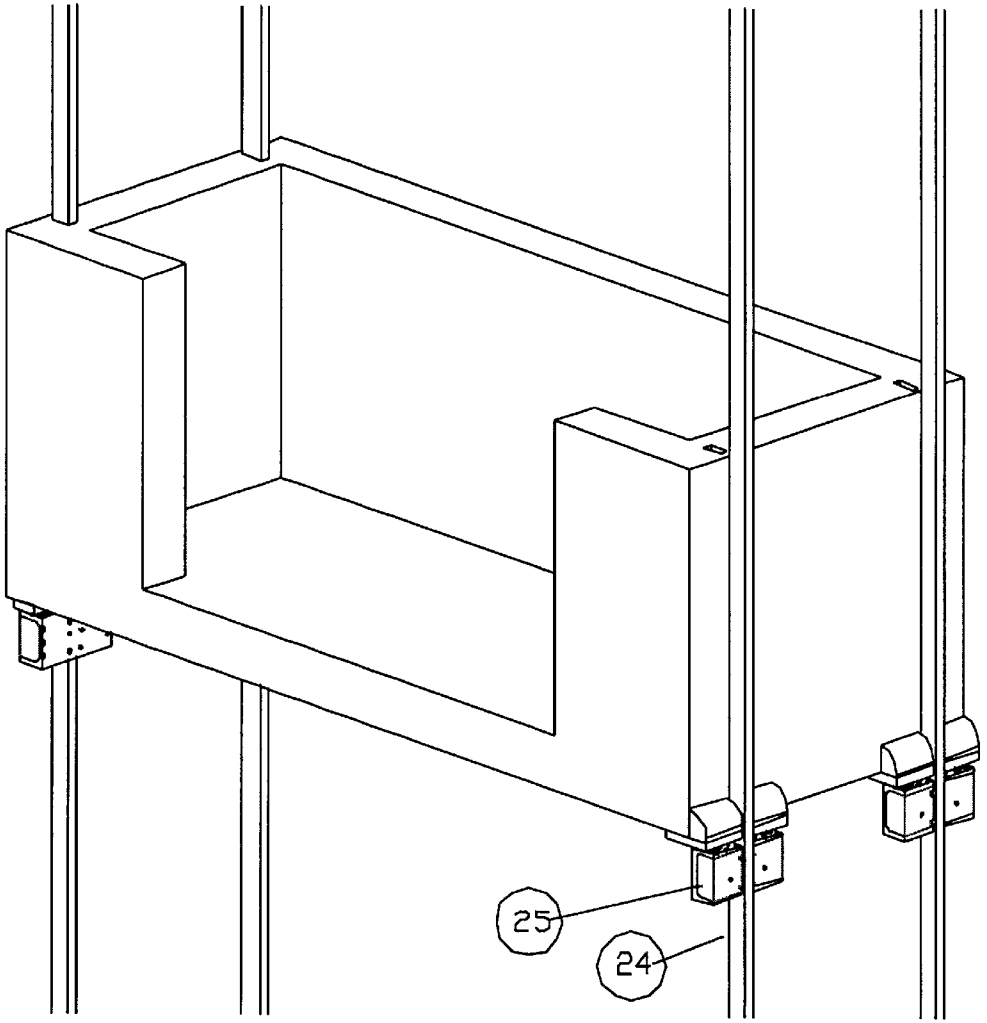
FIG. 3 is the drawing of the mounting of the preferred embodiment gravity-assisted elevator brake on an elevator car or a platform.

Gravity-assisted elevator brake units 25 do not have to be mounted at the bottom of the elevator platform. It can be mounted on top of the platform provided the weight of the platform is coupled to the adapter plate. FIG. 3 shows a preferred mounting on an elevator platform, one unit per rail 24.

Figure 4:
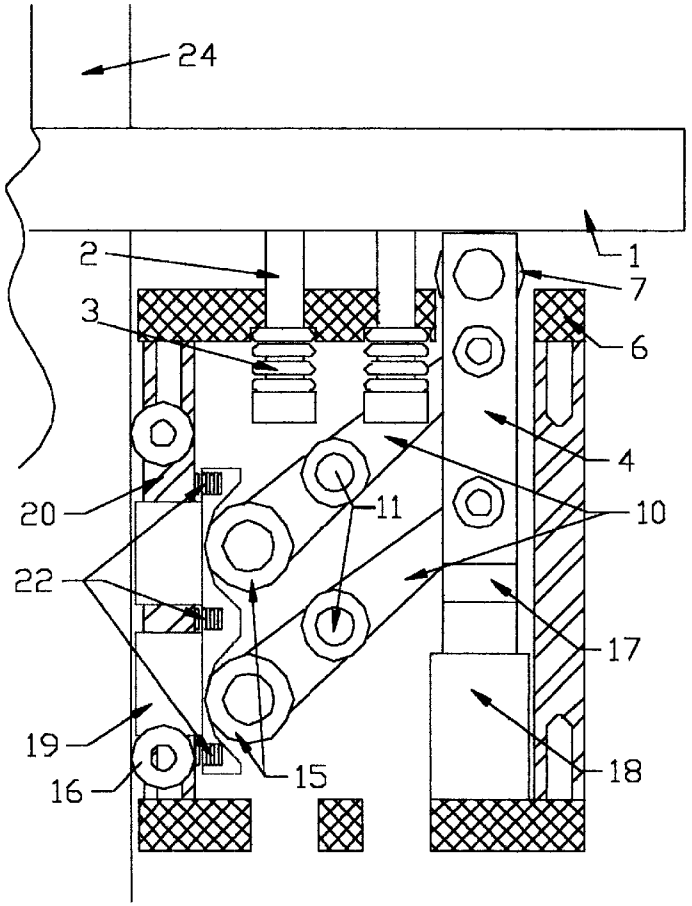
FIG. 4 is a partial and enlarged view of FIG. 1

FIG. 4 is showing mainly braking plate springs 22 embedded to braking plate 19. These braking plate springs keep braking plate always in contact with contact bearing 15. There is shown that the guide bearing 16 embedded in casing 20 and guiding casing 20 along the rail 24.

OPERATION SUMMARY

The adapter plate 1 is bolted below the elevator platform. Adapter plate 1 provide a smooth and even contact surface for load bearing 7 and threaded holes to mount spring studs 2. Spring studs 2 attach the brake unit to the adapter platform 1. The spring studs 2 go through the guide holes existed in brake housing 6 so that when the activator springs 3 push against the spring studs 2 at one end it lifts the brake housing 6 toward the adapter plate 1. As distance between the adapter plate 1 and the brake unit 25 decreases, the smooth surface of said adapter plate compress the load bearing 7 that in turn push the load plates 4 down. As load plates 4 going down arm load bearings 8 encapsulated in said load plates, push load pins 5 down. This movement will automatically engage the activator arm 10. The activator arm 10 in turn will rotate down about pin 11 thus pushing contact bearing 15 into braking plate 19, that in turn clamp against the rail 24.

Note that the gravity-assisted brake also acts as a parking brake since it will set when the lift force is less that the platform weight. Under normal operations, to release the brake, the lift force should exceed the weight of the platform. When there is no weight acting on the load plate 4, the force in the activator spring 3 less the weight of the braking unit will keep the brake engaged. Hence brake release element 18 has to be activated to disengage contact searing 15 from the braking plate 19. In FIG. 4, braking plate 19 is pushed back by springs 22 against casing 20, said braking plate 19 is released from the rail 24 when brake release element 18 is energized. The force needed to release the brake has just to exceed the weight of the linkages plus the activation spring force. Also shows example of gravity-assisted brake in functional aspect. Consider a the activator arm 10 in FIG. 1, let point A denote the center of pin 14, let point B denote the center of pin 11, and let C denote the center of pin 9. Let θ be the angle the activator arm makes with the horizontal. Also let $F_{load}$ denotes the component of the total elevator platform weight on each of the brake unit that is applied to pin 9 at point C. let $F_{contact}$ denotes the contribution to the clamping force by each activator arm 10 on pin 14 at A. Simple analysis of moments at point B yields:

$$F_{Load}(AC-AB)\cos\theta=F_{Contact}AC\sin\theta \quad (4)$$

Equation (1–3) can be used to determine the location of the lever arm fulcrum depending on the friction factor $\mu$ and footprint of the brake. For example, if $F_{Load}$ and $F_{contact}$ are fixed which is the case if the total weight of the platform and the required clamping forces are specified, then $$\frac{(AC - AB)}{AC} = \frac{F_{\text{Contact}} \tan\theta}{F_{\text{Load}}} \quad (5)$$

For a fixed angle θ, equation (4) was used to determine the length of the activator arm 10, and the location of the lever arm fulcrum. The location of the fulcrum can be adjusted for different operational conditions and braking surfaces. During operation, for elevators that are subject to external forces, the motion of the elevator proportionally contributes to the clamping force. When the brake release elements 18 are deactivated, the brake units are engaged by the activator springs 3 and the weight of the platform thus this configuration could be used as emergency brake and a parking brake.

In accordance with the provisions of the patent statutes, the present invention has described what is considered the preferred embodiment. However it understood that the present invention can be practiced otherwise than as specifically described herein and still will be with in the spirit of the following claims.

What are claimed is:

1. A gravity-assisted elevator brake, comprising:

a) at least one lever system to transmit the elevator platform weight to the braking mechanism;

b) a flat and smooth adapter plate with spring studs and springs that are compressively wedged between the spring studs and the brake unit housing to support the weight of the brake unit;

c) a braking mechanism with braking plates that clamp on to a rail; and d) a brake release unit sized to provide a force slightly larger than the weight of the brake unit.

2. A gravity-assisted elevator brake according to claim 1 in which the weight of the total elevator platform is used to generate the clamping force necessary to stop the elevator.

3. A gravity-assisted elevator brake according to claim 1 in which the said lever system is used to magnify the weight of the platform to account for the coefficient of friction.

4. A gravity-assisted elevator brake according to claim 1 that is an emergency brake as well as a parking brake.

5. A gravity-assisted elevator brake according to claim 1 that self adjust the clamping forces accordingly to the weight and momentum of the platform and cargo.

6. A gravity-assisted elevator brake according to claim 1 in which the power to disengage the brake only depends on the weight of the brake unit and is independent of the total elevator platform weight.

* * * * *